United States Patent [19]

Champagne

[11] Patent Number: 4,875,315

[45] Date of Patent: Oct. 24, 1989

[54] FRAME FOR SUPPORTING STAIRS OR THE LIKE

[76] Inventor: Vénérand R. Champagne, 8720, des Mille-Isles, Laval, Quebec, Canada, H0A 1G0

[21] Appl. No.: 205,831

[22] Filed: Jun. 13, 1988

[51] Int. Cl.[4] ..... E04F 11/10; E04F 11/12; E04F 11/14

[52] U.S. Cl. ..... 52/189; 52/191

[58] Field of Search ..... 52/182, 191, 189, 183, 52/184, 188; 108/92, 101; 182/220

[56] References Cited

U.S. PATENT DOCUMENTS

| | | | |
|---|---|---|---|
| 960,207 | 5/1910 | Slater | 52/299 |
| 1,075,156 | 10/1913 | Nesdall | 52/191 |
| 1,925,642 | 9/1933 | Meredith | 52/191 |
| 2,021,457 | 11/1935 | MacKenzie | 52/191 |
| 4,015,687 | 4/1977 | Dean | 52/182 |
| 4,583,335 | 4/1986 | Morellini | 52/182 |

FOREIGN PATENT DOCUMENTS

| | | | |
|---|---|---|---|
| 1380266 | 10/1964 | France | 52/191 |

*Primary Examiner*—John E. Murtagh
*Attorney, Agent, or Firm*—Roland L. Morneau

[57] ABSTRACT

A stair supporting frame made of a pair of stringers and a set of triangular blocks slidingly fitted in a groove provided in upper surface of the stringer. The groove has a uniform width defined by parallel sidewalls and the width of the blocks corresponds to the width of the groove. The blocks can slide into and along the groove. The degree of penetration of the blocks in the groove does not affect the outer appearance of the blocks relative to the stringer.

9 Claims, 3 Drawing Sheets

FIG. 3.
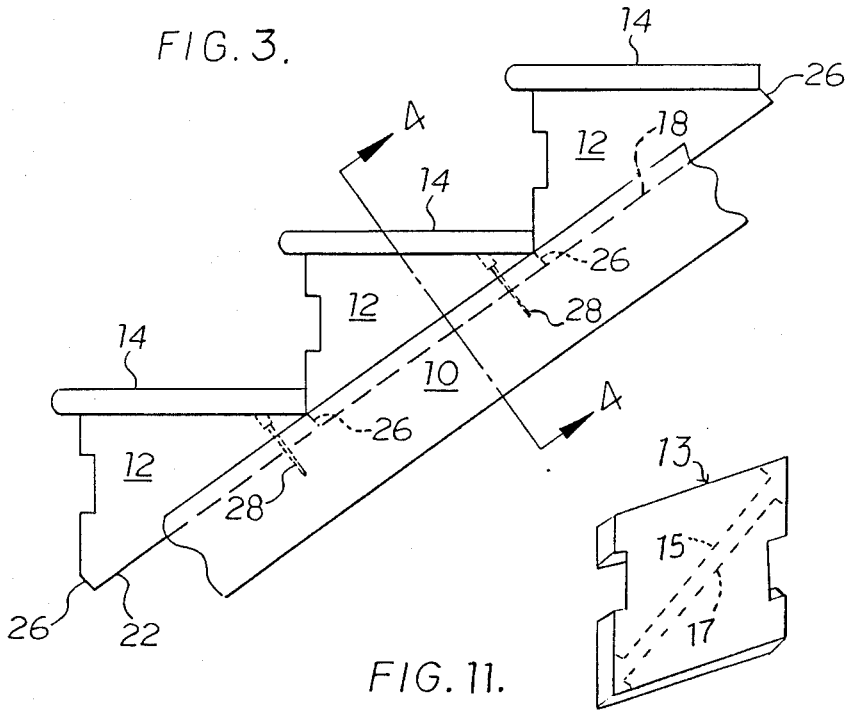
FIG. 11.
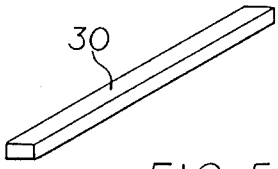
FIG. 5.
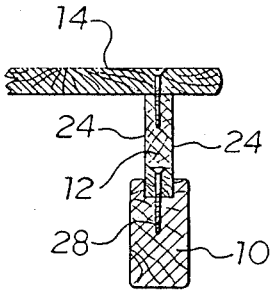
FIG. 4.
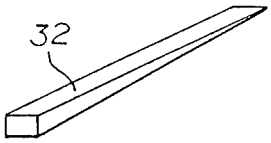
FIG. 6.

FRAME FOR SUPPORTING STAIRS OR THE LIKE

BACKGROUND OF THE INVENTION

1. Field of the invention:

The invention relates to a supporting frame for a platform, balcony, stairs or the like and more particularly to a prefabricated stair kit. It includes a pair of grooved stringers and a set of support blocks slidingly fitted in the groove of the stringers for supporting the treads of the stairs.

2. Prior Art:

U.S. Pat. No. 2,021,457 is directed to a stair carriage made of grooved stringers and a set of blocks each connected to the stringers by a spline or a tongue. The groove of the stringer is adapted to receive only the spline or the tongue. Considering the limited degree of precision in making these parts, a gap is quite often likely to appear at the intersection of the stringer and support block. Furthermore, and as explained in the above mentioned patent, spacers are needed when the block do not have the desired dimensions. The use of such spacers causes an opening between the upper edge of the riser and the bottom of the tread. To hide this opening, a molding strip is used. When the stringers are not quite at the same angle relative to the ground or for some similar reasons, it is useful to be able to vertically raise the blocks without the use of the spacers. Such modification cannot be made because the spline and the tongue mentioned above cannot be adjusted.

It is an object of the present invention to overcome the above described disadvantages.

SUMMARY OF THE INVENTION

A stair supporting frame is made of a pair of elongated stringers and a set of trianguloid support blocks. Each stringer has a groove centrally located on its upper surface. The groove has an orthogonal U-shaped cross-section of uniform and constant width. The blocks have substantially flat and parallel lateral sides and a thickness corresponding to the width of the groove so that the lateral sides of the whole block adjacent the hypothenuse, fittingly slide in the groove. The flatness of the internal walls on each side of the groove, in the upper surface of the stringer forms a shoulder profile with the sidewalls of the blocks and this profile remains the same regardless the amount of penetration of the block in the groove. Such arrangement is similarly suitable for the supporting frame of a platform, balcony or the like. Horizontal beams provided with a U-shaped groove are adapted to receive truss beams secured underneath a platform. The width of the grooves corresponds to the width of the truss-beams.

BRIEF DESCRIPTION OF THE DRAWING:

FIG. 3 is a side view of the staircase shown in FIG. 1, FIG. 4 is a cross-sectional view taken along line IV—IV of FIG. 3, FIGS. 5 and 6 are perspective views of a slat and a wedge used for adjusting stairs in the invention.

FIG. 11 is a perspective view of a square block for making traingular blocks.

Figure 2:
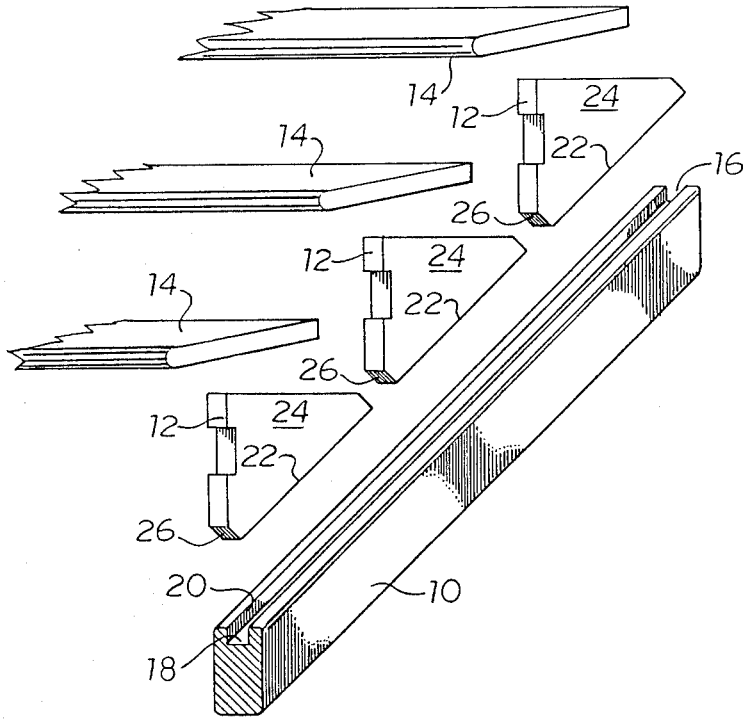
FIG. 2 is an exploded view of the portion of the staircase shown in FIG. 1.
Figure 1:
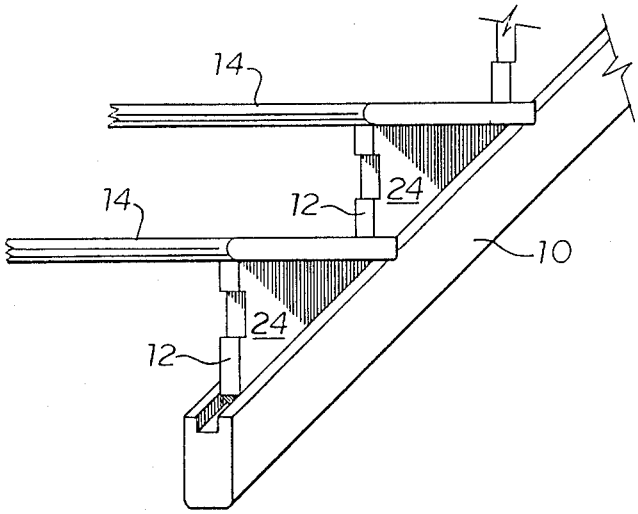
FIG. 1 is a perspective view of one side of a staircase illustrating the invention.

DETAILED DESCRIPTION OF THE INVENTION:

The staircase is illustrated in FIGS. 1 and 2 comprises a frame essentially made of a stringer 10 and a set of support trianguloid blocks 12. The threads 14 are secured on the horizontal surface of the blocks 12.

Stringer 10 is provided on its upper surface with a longitudinal groove 16 centrally located on its upper surface. The groove 16 has a cross-sectional U-shape. The groove has a rectilinear bottom surface 18 and a uniform width defined by flat parallel internal walls 20. The blocks 12 are generally triangular in shape and their hypothenuse surface 22 are adapted to rest on the rectilinear bottom surface 18 of the groove 16. The blocks 12 have a uniform width defined by parallel flat sidewalls 24. The width of the portion of the blocks 12 adjacent the hypothenuse surface 22 corresponds to the width of the grooves 16 to allow the blocks 12 to slide in the groove 16 along the axis of the groove and also in the direction perpendicular to the axis of the groove.

The widht of the blocks 12 being slidingly fitting in the width of the groove 16 enables non-experts to install staircases according to the invention. The lower blocks 12 are first installed with their corresponding thread 14 and consecutively the adjacent blocks 12 above and their corresponding thread 14 are installed by sliding them in abutment with the lower block and thread. The corners of the triangular blocks 12 adjacent the hypothenuse surface 22 are bevelled to provide an abutment surface 26 between the blocks. The staircase is usually solidifyed by adding glue in the groove 16 and/or by inserting screws or nails 28 between the blocks and the stringer.

The present frame for stairs has many advantages. Only one uniform groove in the stringer 10 is needed. The blocks 12 having the width of the groove 16, are easily inserted into the groove. No tongue nor spline such as described in the above-mentioned patent is needed. Such spline and tongue constitute additional labour for the production and the installation of the blocks. One advantage of the present invention is that the blocks can be easily made as long as it has the correct width and contour. Another advantage of the present invention is that the block 12 may more or less penetrate in the groove without changing outer appearance of the intersection between the raiser blocks 12 and the stringer 10. This is a very useful advantage when an error or a miscalculation occurs in the levelling of the thread 14 or in the difference of angular relationship between the position of the stringer and the hypothenuse surface 22 of the blocks 12. FIG. 5 illustrates a slot 30 which may be introduced on the bottom of the groove 16 in order to raise the rasier block which is mounted over it. Even when such a slat 30 is positioned in the bottom of the groove 16, the outer appearance of the block 12 relative to the stringer 10 is not affected. In fact, the block 12 may be provided all painted or varnished in kits and the upward movement of the block in the groove will not change the outer appearance of the staircase. Another error may be corrected with a wedge 32 illustrated in FIG. 6 when the front of the thread 14 needs to be raised relative to the back of the thread. Again, when such correction is made, the outer appearance of the staircase is not affected. Such correction cannot be made by the stair carriage proposed in the above-mentioned patent without affecting the outer appearance of the staircase. As a matter of fact, any space between the block and stringer would require a filling material or a strip to close and hide the fissure.

In the applicant's arrangement, the corrections are made with a slat 30 or a wedge 32 while in the U.S. Pat. No. 2,021,457, the corrections are made with spacers and such spacers causes an opening at the top of the raisers which needs to be hidden by a molding strip below the thread of the staircase.

Considering that the stairs are not all set at the same angle relative to the ground, the triangular blocks 12 are preferably provided in substantially square plate 13 as shown in FIG. 11. The plates 13 have the desired width corresponding to the width of the groove 16. They are cut on the premises, in two triangular blocks along the lines 15 and 17 after the stringer has been installed and its inclination determined. This easy adaptation of the angular shape of the blocks 12 during the assembly of the stairs on location, is made possible because the triangular blocks have a flat hypothenuse surface 22 and flat sidewalls 24. If the hypothenuse surface would require a dovetail joint, such adaptation on the building site could not be contemplated.

Another advantage of the present invention exists when the thickness of the threads corresponds to the thickness of the blocks 12. For whatever reason, it happens that one or more triangular blocks is missing or scrapped during the installation of the stairs, it is possible to use one thread and cut it to the size of the blocks 12 needed, using the usual tools available on site.

Figure 7:
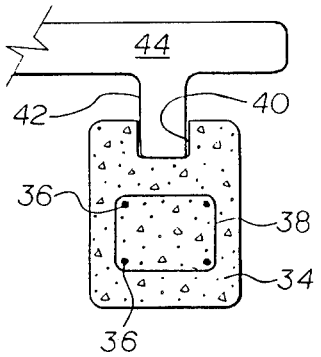
FIG. 7 is a cross-sectional view similar to FIG. 4 using a ciment stringer.

FIG. 7 illustrates a cross-sectional view corresponding to the sectional view shown in FIG. 4 wherein the stringer is made of cement 34 and provided with a groove 40 in which a block 42 is slidingly fitted similarly as blocks 12 shown in FIGS. 1 to 4. The block 42 may also be made of cement with the thread 44. The thread 44 is spaced from the stringer 34 and an adjustment in height may be made by the insertion of slots in the bottom of the groove 40.

Figure 8:
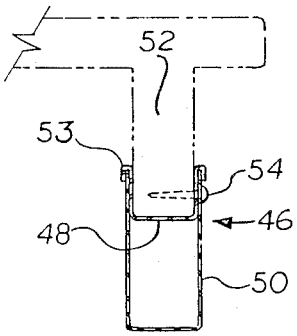
FIG. 8 is a cross-sectional view similar to FIG. 4 using a sheet metal stringer.

FIG. 8 illustrates a stringer 46 made of sheet metal. It consists essentially of a U-shaped bracket 48 having curved lips 53 at both free ends of the U-shape. The braket 48 is supported by a U-shaped frame 50 sadling the sides of the U-shaped bracket 48. The lips 53 hooks on the free edges of the frame 50. The threads support blocks 52 slidingly fit into the U-shaped bracket 48 and is fixed therein with screws or nails 54.

Figure 9:
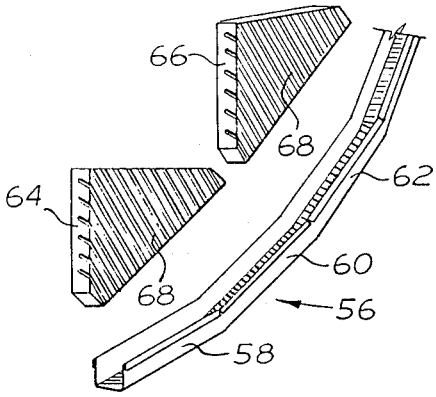
FIG. 9 is an exploded view of a curved sheet metal stringer and support blocks adapted to sit in the stringer and, FIG. 10 is a combination of a platform and stringers made of siment according to the invention.

FIG. 9 illustrates a portion of a sheet metal stringer which is curved for curbed staircases. The stringer 56 is made of angularly oriented portions of the stringers 58, 60 and 62 adapted to slidingly received support blocks 64 and 66. These blocks 64 and 66 can be raised inside the stringer 56 for adjustment such as explained earlier. When the stringer 56 is made with a continuous curve, the support blocks 64 and 66 are provided with slots 68 on one of their sidewalls so as to allow the bending of these blocks according to the curve of the stringer 56.

The stringer 56 and the U-shaped frame 50 may be supported from underneath or on the side of an existing partition which constitute a saving in the construction of the stairs. Both elements 50 and 56 are, in such instances, provided with perforations on their sidewalls or on their bottom surface, so that they can be nailed or screwed to the partition.

Figure 10:
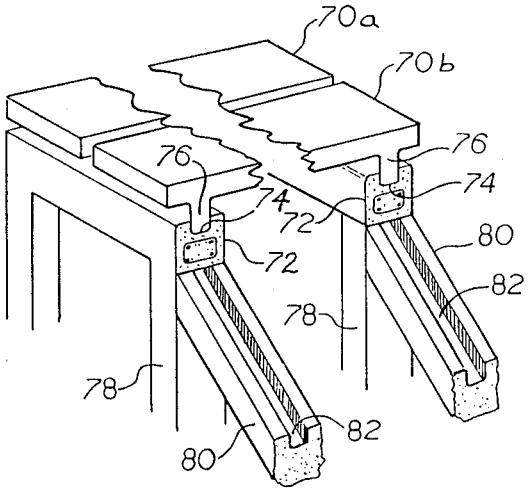

Some arrangements as explained above may be used to support a platform 70 as illustrated in FIG. 10. A pair of spaced beams 72 provided with U-shaped grooves 74 on their upper surface are adapted to receive truss beams 76 secured to the platform 70. The platform 70 may be made of slabs 70a and 70b which are slidingly fitted over the beams 72 disposed in corresponding spaced relationship with the truss beams 76. The beams 72 are moutned on columns 78. A staircaase, as explained above, may be mounted over the stringers 80 which are provided with grooves 82 on their upper surface. The arrangement illustrated in FIG. 10 is usually made of cement. Support blocks and threads of the type illustrated in FIG. 7 are secured by cement or an appropriate glue in the grooves 80.

The installation of the staircase illustrated in FIGS. 1 to 4 is made easy for an average handyman. The length of the stringer 10 is established according to the total height from floor to floor to be connected. With the height of the raiser and the depth of the stringer, it is possible to determine the size of the support block 12. The selection of the thread is made according to the width of the staircase and the depth of the support block 12. The present staircase is made of relatively small pieces which can be assembled and disassembled in a relatively easy and precise manner. Furthermore, this assembly is suitable for the use of wood, metal, cement and other similar material.

The equipment supplied to built staircases according to the invention may be provided in kits. If a thread support block 12 has been damaged, it is easy to make a substitute by cutting from a board having a similar thickness, a triangular block corresponding to the triangular blocks supplied in the kit. This possibility would not exist if the blocks 12 and the stringer 10 would be assembled with a tongue or a spline.

Whenever the stringer and the support block have the same outer thickness, such as in United States patent No 2,021,457, an error of alignment between these two parts would deteriorate the appearance of the side of the staircase. Such error of alignment does not exist according to the present invention. The degree of penetration of the blocks in the groove does not change the outer appareance of the blocks relative to the stringer.

Furthermore, with the assembly according to the above mentioned patent, the line of intersection between the support block and the stringer or any error in alignment as mentioned above, would require some patching to improve the appearance.

With such an arragnement, unfinished wood would be needed while in the applicant's invention, prepainted or pre-varnished wood may be used which expedite and simplify the completion of the staircase.

I claim:

1. A frame for supporting a platform, a staircase or the like comprising:

at least two spaced longitudinal beams, each beam having a longitudinal groove centrally located on its upper surface, each of said grooves having a flat rectilinear bottom surface and a uniform width defined by flat, parallel internal walls, a platform section and a pair of spaced truss beams secured to and under said platform, said truss beams having a flat rectilinear bottom surface across their width, and a uniform width defined by parallel, flat sidewalls, the distance between the said truss beams corresponding to the distance between the longitudingal beams, the full width of said truss beams corresponding to the width of said grooves to allow the truss beams to fittingly slide both downwardly into said grooves and longitudinally along the grooves, the height of said truss beams being greater than the depth of said grooves, the bottom of said truss beams being adapted to rest in the bottom of the grooves while maintaining the platform spaced from the upper surface of the longitudinal beams.

2. A stair supporting frame comprising:

a pair of elongated stringers adapted to be spacedly mounted in parallel relationship, each having a longitudinal groove centrally located on its upper surface, the said groove having a rectilinear flat bottom surface and a uniform width defined by flat, parallel internal walls, a set of trianguloid blocks for supporting threads of stairs having a flat hypothenuse surface across their full width adapted to rest on the rectilinear flat bottom surface of the groove, said blocks having a uniform width defined by parallel, flat sidewalls, the full width of the portion of the blocks adjacent the hypothenuse surface corresponding to the width of the groove to allow the said blocks to fittingly slide both downwardly into said grooves and longitudinally along said grooves, and the width of said blocks being equal or narrower then the width of said portion.

3. A stair supporting frame as recited in claim 2, wherein the stringers are made of wood.

4. A stair supporting frame as recited in claim 2, wherein the stringers are made of cement.

5. A stair supporting frame as recited in claim 2, wherein the stringers are made of sheet metal.

6. A stair supporting frame as recited in claim 2, comprising a thread secured to a pair of said blocks, the said pair of blocks being secured to said thread at a distance corresponding to the distance between the stringers of said pair.

7. A stair supporting frame as recited in claim 2, wherein the said blocks are made in pairs, each pair adapted to support a thread, each pair being made from a substantially square plate cut along parallel lines adjacent the diagonal of said plate.

8. A stair supporting frame as recited in claim 6, wherein said blocks have a thickness corresponding to the thickness of the threads.

9. A stair supporting frame comprising:

a pair of elongated stringers adapted to be spacedly mounted in parallel relationship, each having a longitudinal groove centrally located on its upper surface, the said groove having a rectilinear flat bottom surface and a uniform width defined by flat, parallel internal walls, a set of trianguloid blocks for supporting threads of stairs having a flat hypothenuse surface across their full width adapted to rest on the rectilinear flat bottom surface of the groove, said blocks having a uniform width defined by parallel, flat sidewalls, the full width of the portion of the blocks adjacent the hypothenuse surface corresponding to the width of the groove to allow the said blocks to fittingly slide both downwardly into said grooves and longitudinally along said grooves, and the width of said blocks being equal or narrower then the width of said portion, wherein each of the stringers is made of first sheet of metal having a U-shaped cross-section, and a second sheet of metal having U-shaped cross-section of a lesser depth than the first sheet, the said second sheet having an outer lip on the free edge of its U-shape, the said second sheet being inserted inside said first sheet and supported by said lips abutting against the free edges of the first U-shaped sheet metal, wherein the second U-shaped sheet metal constitutes the groove adapted to receive the hypothenuse surface of the blocks.

* * * * *